US007878819B2

(12) United States Patent
Chang et al.

(10) Patent No.: US 7,878,819 B2
(45) Date of Patent: Feb. 1, 2011

(54) SOCKET CONNECTOR HAVING MEASUREMENT PREVENTING CONTACT TERMINAL FROM DROPPING

(75) Inventors: Chun-Yi Chang, Tu-Cheng (TW); Jia-Hau Liu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/702,338

(22) Filed: Feb. 9, 2010

(65) Prior Publication Data

US 2010/0216352 A1 Aug. 26, 2010

(30) Foreign Application Priority Data

Feb. 23, 2009 (TW) ..... 98202642

(51) Int. Cl.
*H01R 12/00* (2006.01)

(52) U.S. Cl. ..... 439/66

(58) Field of Classification Search ..... 439/66, 439/733.1, 91, 591

See application file for complete search history.

(56) References Cited

U.S. PATENT DOCUMENTS 6,648,204 B2 * 11/2003 Waldron-Floyde et al. . 228/44.7
6,872,082 B2 * 3/2005 Hsu et al. ..... 439/66
7,467,950 B2 12/2008 Hai
7,503,770 B2 * 3/2009 Fan ..... 439/66

* cited by examiner

*Primary Examiner*—Khiem Nguyen
(74) *Attorney, Agent, or Firm*—Andrew C. Cheng; Wei Te Chung; Ming Chieh Chang

(57) ABSTRACT

An electrical connector (100) includes an insulative housing (1) and a contact terminal (2). The insulative housing includes a first and a second primary faces (13, 12), and a passageway (11) extending between the first and second primary faces. The passageway defines a first opening (112) at the first primary face and a second opening (111) at the second primary face. The contact terminal is inserted into the passageway through the first opening. The contact terminal is formed with a contact section (24) having a pair of blocking portions (25) projecting along a transversal direction of the first opening. The blocking portion is configured to cooperate with the first primary face to prevent the contact section from entering the first opening

7 Claims, 6 Drawing Sheets

SOCKET CONNECTOR HAVING MEASUREMENT PREVENTING CONTACT TERMINAL FROM DROPPING

BACKGROUND OF THE INVENTION

1. Field of the Invention

The present invention relates to a socket connector, and particularly to a socket connector incorporated with measurement properly retaining contact terminals therein without falling out therefrom.

2. Description of Related Art

U.S. Pat. No. 7,467,950 issued to Fan on Dec. 23, 2008 discloses an electrical connector. The electrical connector comprises a passageway having a first and a second parallel oblique side faces and a contact terminal received in the passageway. The contact terminal comprises a body portion leaning against the first side face, a resilient beam leaning against the second side face, and a U-shaped contact portion between the body portion and the resilient beam and projecting upwardly. The first side face is formed with a protrusion engaging with a slot defined on the body portion of the contact terminal The contact terminal could be secured in the passageway due to the engagement between the protrusion and the slot, even if the electrical connector encounters a harsh environment, such as vibration.

It would be comparably difficult to create an opening within a contact terminal, when the width of the contact terminal becomes smaller and smaller in view of pitch and dimension. Additionally, defining a slot on the contact terminal may create an impact to the quality of the contact terminal.

Hence, an electrical connector having improved blocking member protecting the contact terminal is required to overcome the above-mentioned disadvantages of the related art.

SUMMARY OF THE INVENTION

An object of the present invention is to provide an electrical connector having blocking member preventing the contact terminal from dropping off from a passageway of a housing, the blocking member can be readily incorporated without damaging the contact terminal.

To achieve the aforementioned objects, an electrical connector includes an insulative housing and a contact terminal The insulative housing includes a first and a second primary faces, and a passageway extending between the first and second primary faces. The passageway defines a first opening at the first primary face and a second opening at the second primary face. The contact terminal is inserted into the passageway through the first opening The contact terminal is formed with a contact section having a pair of embossments projecting outward to a distance larger than the width of the first opening The blocking portion is configured to cooperate with the first primary face to prevent the contact section from entering the first opening, when the contact terminal moves upwardly till the first latching position. The passageway includes a pair of obliquely extending first and second side faces and a vertically extending blocking face connecting with the second side face. The contact terminal is compressed by the blocking face and restricted between the blocking face and the first side face, when the contact terminal moves downwardly till a second latching position.

The blocking member comprises a pair of blocking portions formed on the contact section of the contact terminal and a vertically extending blocking face in the passageway. The contact terminal is prevented from jumping upwardly out of the insulative housing due to the blocking portions and is prevented from downwardly dropping off the insulative housing due to the blocking face. The contact terminal is hard to drop off the insulative housing. Accordingly, the contact terminal is difficult to be removed from the passageway of the insulative housing. The blocking portions are easy to be created on the contact terminal, even if the contact terminal is designed with a small dimension. Forming the blocking portions or the blocking face would not distort the contact terminal. The quality of the contact terminal would not be worsened.

Other objects, advantages and novel features of the invention will become more apparent from the following detailed description of a preferred embodiment when taken in conjunction with the accompanying drawings.

DETAILED DESCRIPTION OF THE INVENTION

Figure 1:
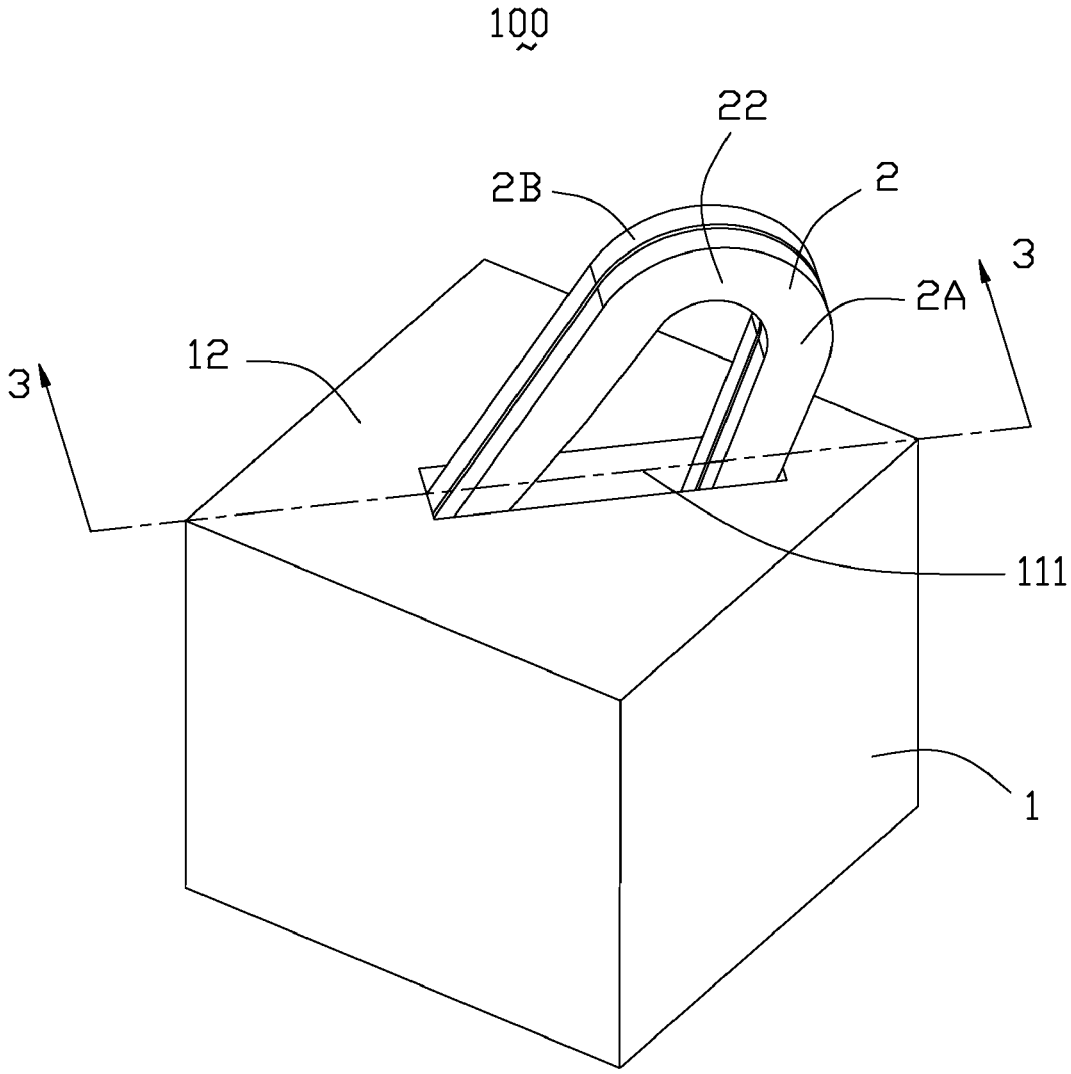
FIG. 1 is an assembled perspective view of an electrical connector in accordance with the present invention.

Reference will now be made to the drawing FIGS. to describe the present invention in detail. Referring to FIGS. 1-6, a partially disclosed electrical connector 100 made in accordance with the preferred embodiment of the present invention comprises an insulative housing 1 defining a passageway 11 and a contact terminal 2 secured in the passageway 11 of the insulative housing 1. It is noted that the housing 1 is only schematically partially shown to illustrate a single contact terminal 2 from clarity purpose. In actual use, the housing may be configured to include a plurality of passageways and retain a plurality of contact terminals.

Referring to FIGS. 1-4, the insulative housing 1 comprises a top face 12 and a bottom face 13. The passageway 11 extends between the top face 12 and the bottom face 13. The passageway 11 reaches to the top face 12 to define a top opening 111 at the top face 12 and reaches to the bottom face 13 to define a bottom opening 112 at the bottom face 13. The top opening 111 and the bottom opening 112 are offset from each other with respect to a direction vertical to the top face 12 and the bottom face 13. The insulative housing 1 has obliquely extending first and second side faces 113, 114 surrounding the passageway 11. The insulative housing 1 has a vertically extending blocking face 115 connected with the second side face 114. The length of the top opening 111, i.e. the distance between the first and second side faces 113, 114, is greater than the length of the bottom opening 112, i.e., the distance between the first side face 113 and the blocking face 115.

The contact terminal 2 is substantially U-shaped. The contact terminal 2 has a pair of plate portions 2A, 2B adhered into a whole. The contact terminal 2 comprises a U-shaped contact portion 22, a body portion 21 and a resilient beam 23 extending from opposite ends of the contact portion 22. The resilient beam 23 has a resisting portion 231 formed at the free end thereof The contact terminal 2 has a contact section 24 formed at a free end of the body portion 21. The contact section 24 is formed with a pair of blocking portions or embossments 25, symmetrically projecting along a transversal direction of the bottom opening 112.

Figure 2:
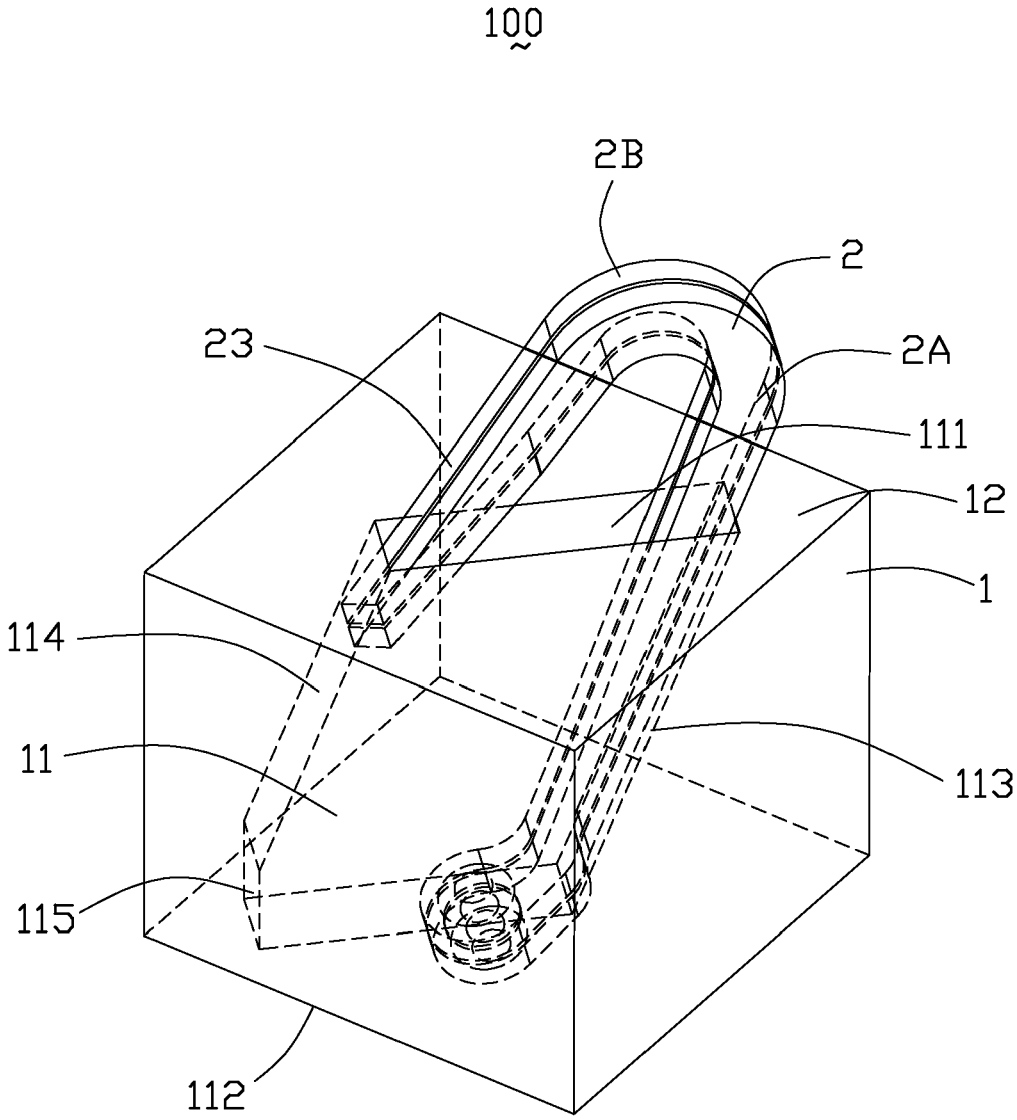
FIG. 2 is a transparent view similar to FIG. 1, showing a coupling between a contact terminal and a passageway of an insulative housing.
Figure 3:
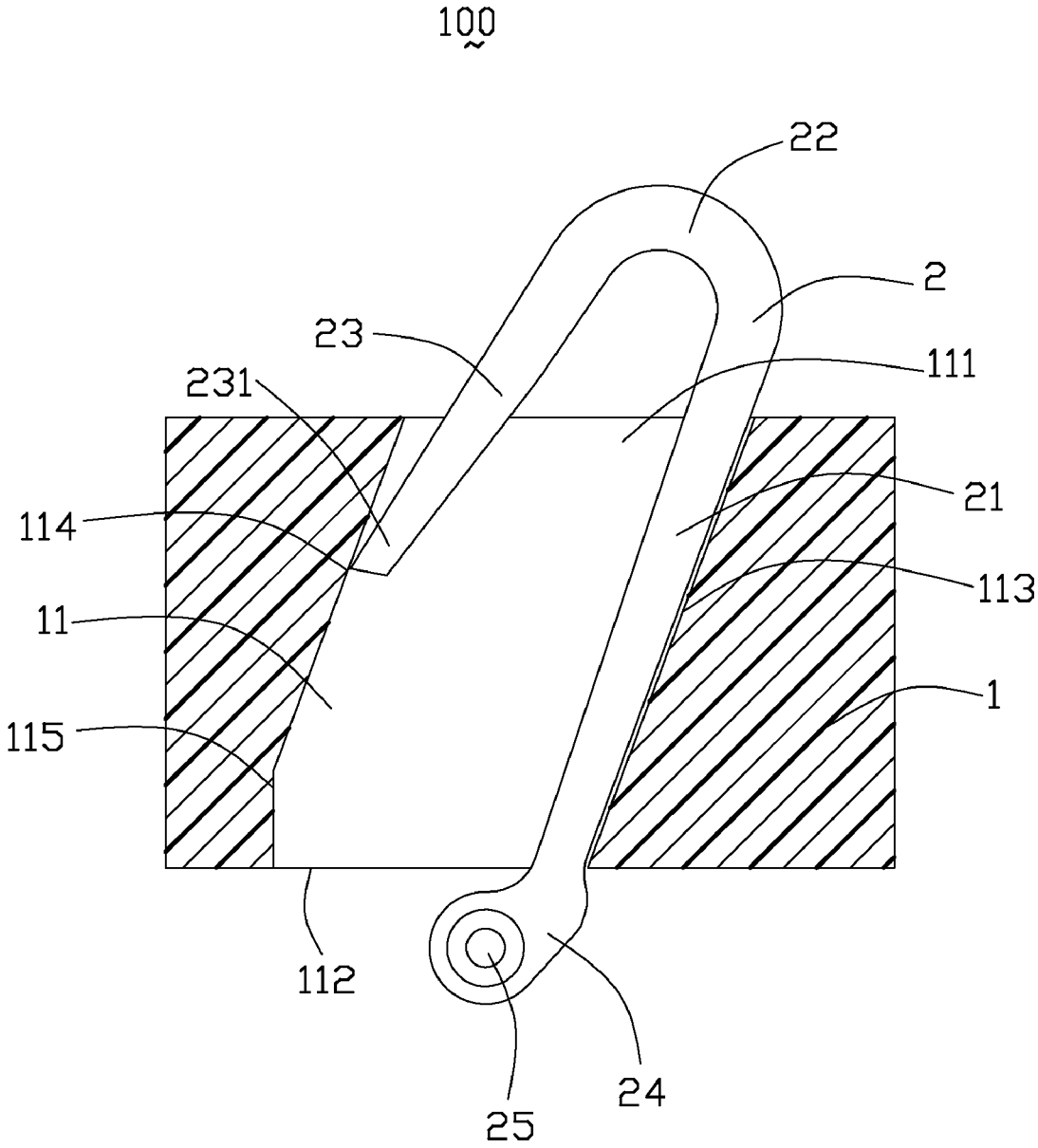
FIG. 3 is a cross-sectional view of the electrical connector, taken along line 3-3 of FIG. 1.
Figure 4:
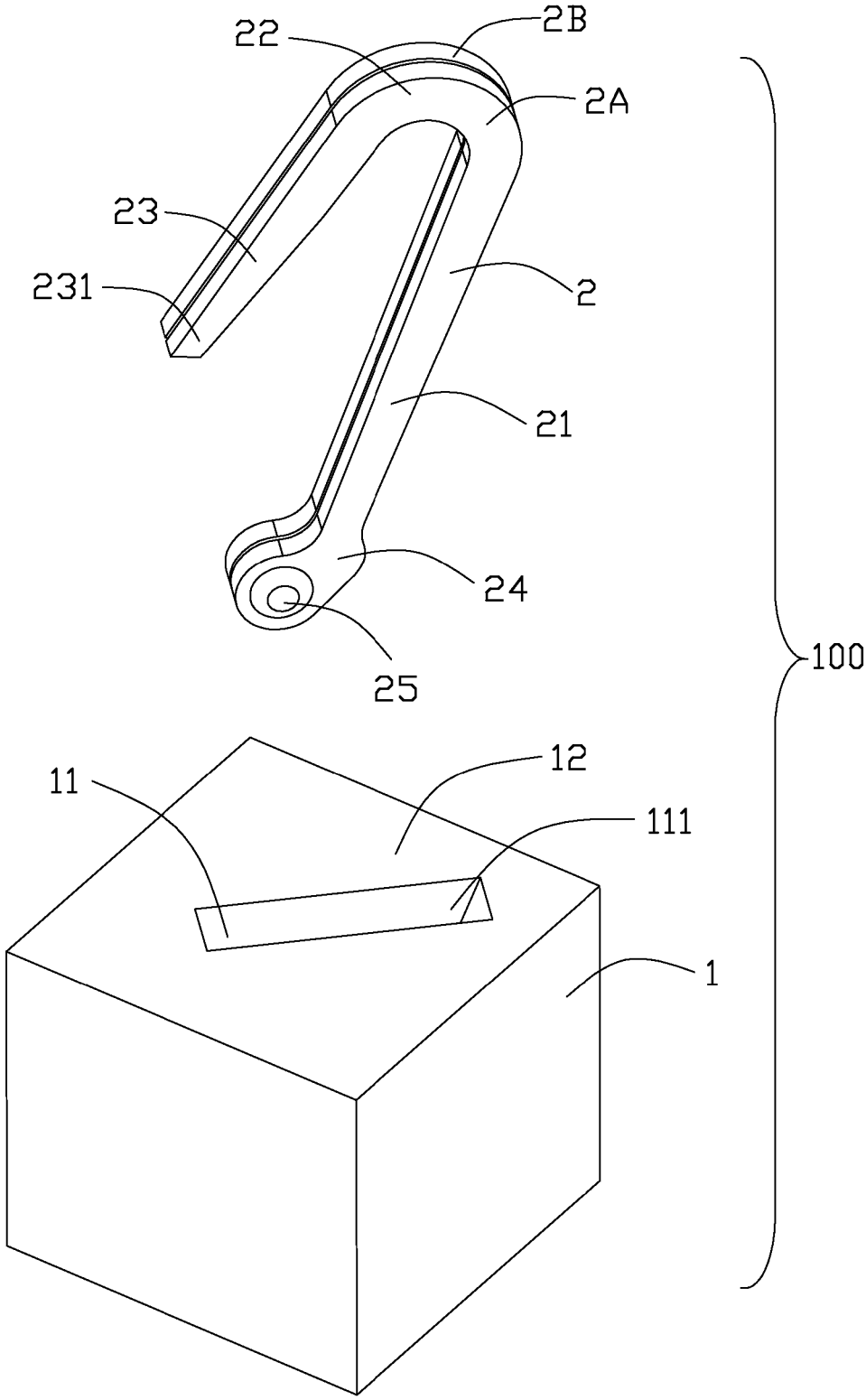
FIG. 4 is an exploded perspective view of the electrical connector.
Figure 6:
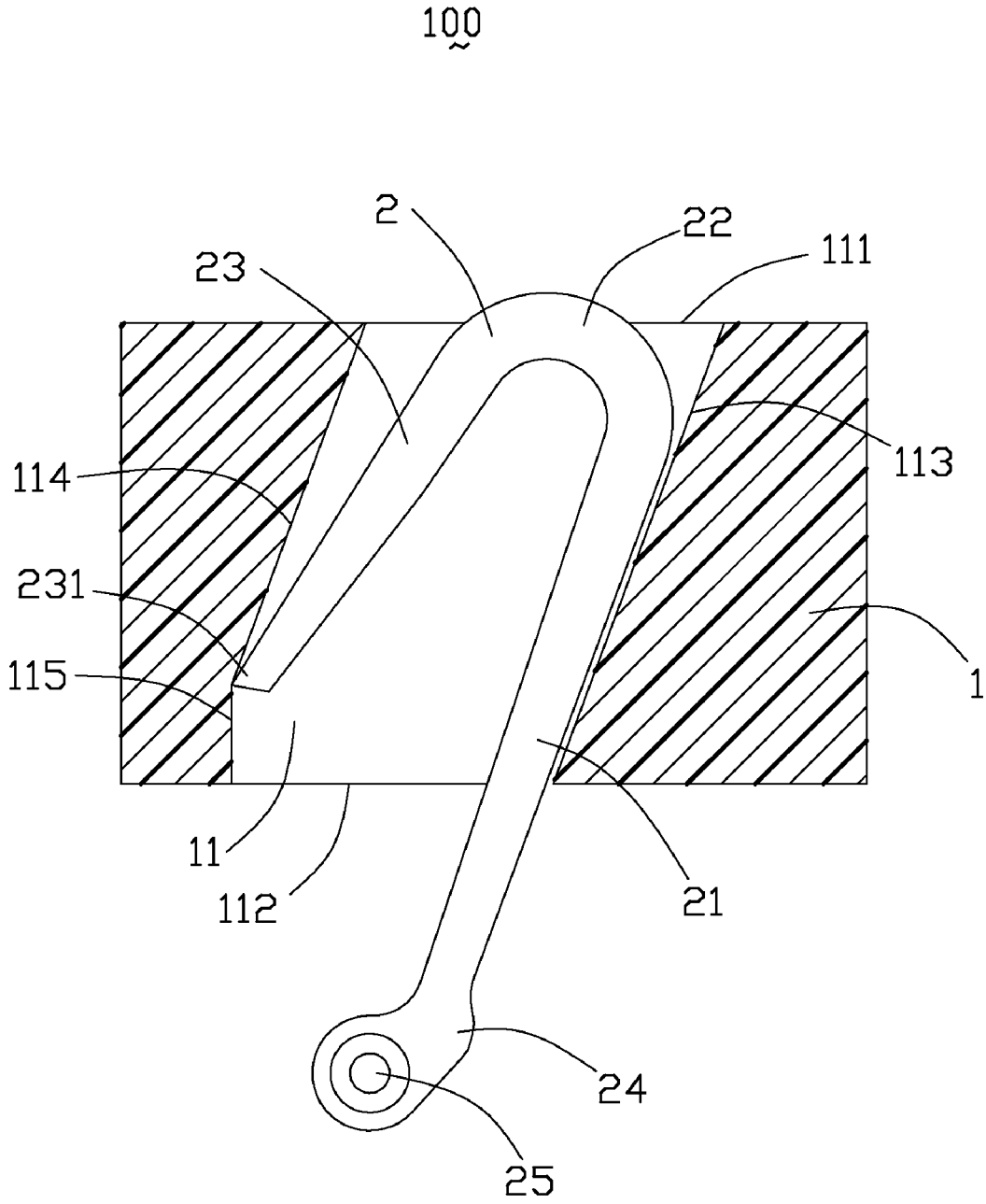
FIG. 6 is a cross-sectional view of the electrical connector, when the contact terminal moves downwardly till a second latching position.

Referring to FIGS. 2 and 3, the contact terminal 2 is inserted into the passageway 11 through the bottom opening 112. The contact terminal 2 is secured in the passageway 11, with the contact portion 22 projecting outward of the passageway 11 beyond the top opening 111. The body portion 21 of the contact terminal 2 leans against the first side face 113 and the resisting portion 231 is slidable along the second side face 114. The contact section 24 is located below the bottom opening 112. Referring to FIG. 6, a distance between the pair of embossments 25 is greater than a width of the bottom opening 112.

Figure 5:
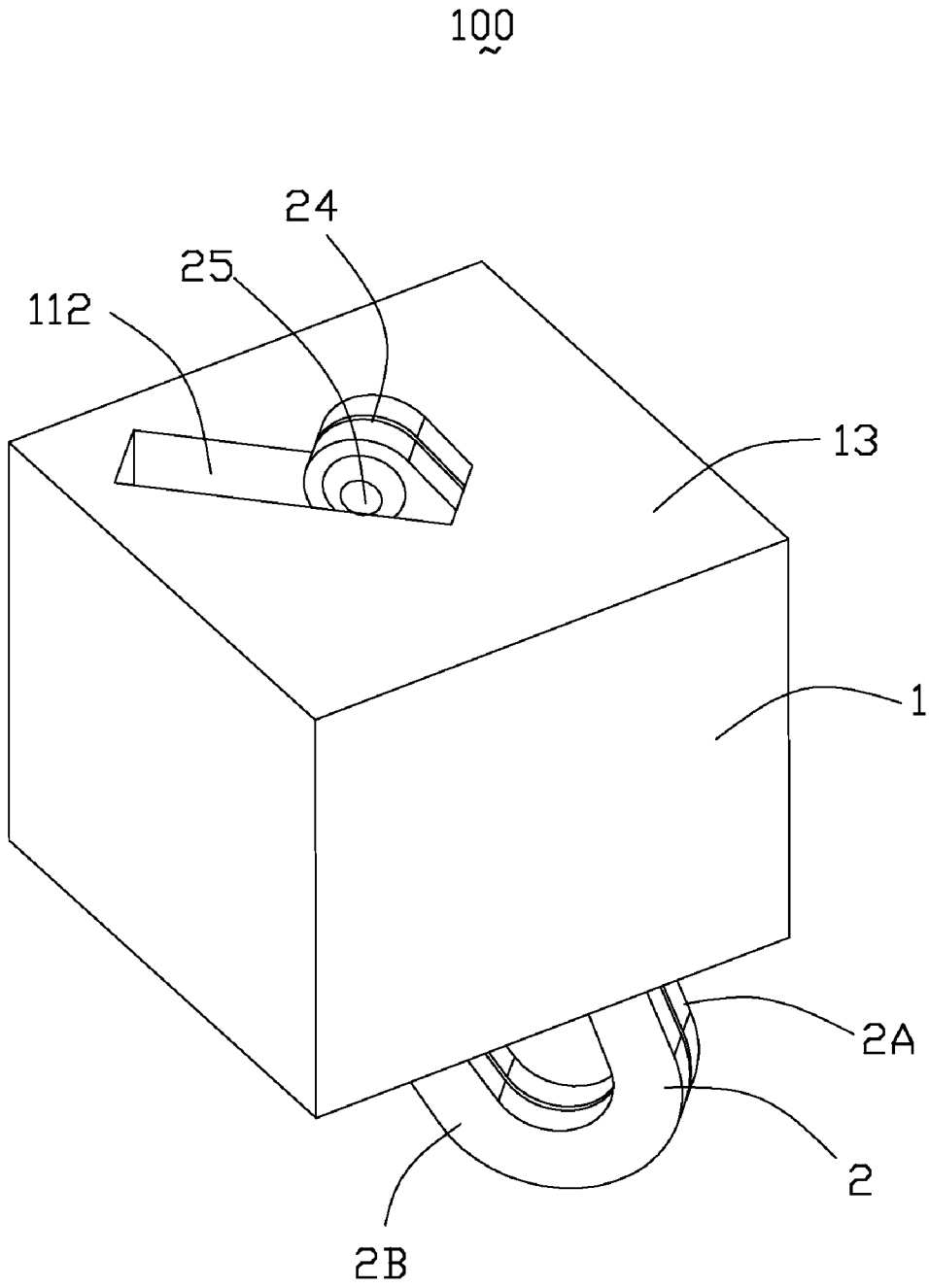
FIG. 5 is an assembled perspective view of the electrical connector, when the contact terminal moves upwardly till a first latching position.

When the electrical connector 100 encounters a vibration, the contact terminal 2 moves along an up-to-bottom direction in the passageway 11. Referring to FIG. 5, when the contact terminal 2 moves upwardly to a first latching position in the passageway 11, the embossments 25 will abut against the bottom face 13 of the insulative housing 1. The distance between the pair of embossments 25 is greater than the width of the bottom opening 112. The embossments 25 are prevented from entering into the passageway 11. Therefore, the contact terminal 2 is prevented from keeping on moving upwardly to jump out of the passageway 11.

Referring to FIG. 6, when the contact terminal 2 moves downwardly to a second latching position in the passageway 11, the resisting portion 231 slides along the second side face 114 and arrives at the blocking face 115. The distance between the blocking face 115 and the first side face 113 is smaller than the distance between the first and second side faces 113, 114. The resilient beam 23 is resiliently compressed by the blocking face 115, and the contact terminal 2 is restricted between the blocking face 115 and the first side face 113. The contact terminal 2 is prevented from dropping off the passageway 11 through the bottom opening 112.

The passageway 11 is formed with the obliquely extending first and second side faces 113, 114 and the vertically extending blocking face 115 connecting with the second side face 114, to prevent the contact terminal 2 from downwardly dropping off the passageway 11. The contact terminal 2 is formed with a pair of embossments 25 blocked by the bottom face 13, to prevent the contact terminal 2 from upwardly dropping off the passageway 11. The contact terminal 2 is protected.

However, the disclosure is illustrative only, changes may be made in detail, especially in matter of shape, size, and arrangement of parts within the principles of the invention.

What is claimed is:

1. An electrical connector comprising: an insulative housing comprising a first and a second primary faces, and at least a passageway extending between the first and second primary faces, said passageway defining a first opening at the first primary face and a second opening at the second primary face; and a contact terminal inserted into the passageway through the first opening, said contact terminal being formed with a contact section having a blocking portion projecting along a transversal direction of the first opening, said blocking portion being configured to cooperate with the first primary face to prevent the contact section from entering into the first opening, wherein said contact section of the contact terminal comprises a pair of said blocking portions, a distance between the pair of blocking portions being greater than a width of the first opening, wherein said contact terminal has a pair of plate portions adhered as a whole, and said pair of blocking portions are symmetrically formed on the pair of plate portion, wherein said contact terminal has a substantially U-shaped configuration and is flexible along a longitudinal direction perpendicular to said transversal direction, wherein said passageway has an obliquely extending first and second side faces and a vertically extending blocking face connecting with the second side face, a horizontal distance between the blocking face and the first side face being smaller than a horizontal distance between the first and the second side faces, wherein said first and second openings are offset with respect to a direction vertical to the first and second primary faces, wherein said contact terminal comprises a body portion leaning along the first side face, and a resilient beam having a resisting portion slidable along the second side face.

2. The electrical connector as claimed in claim 1, wherein said contact terminal comprises a contact portion between the body portion and the resilient beam, said contact portion projecting outward of the insulative housing through the second opening.

3. The electrical connector as claimed in claim 1, wherein said contact terminal is resiliently compressed by the blocking face and restricted between the blocking face and the first side face, when the resisting portion slides along the second side face and arrives at the blocking face.

4. An electrical connector comprising: an insulative housing defining opposite first and second surfaces thereon; a slit type passageway extending through the housing and communicating with both said first surface and said second surface, in a cross-sectional view the passage defining an upward oblique side face and a downward oblique side face opposite to said upward oblique side face under condition that said downward oblique side face defines a section angled thereto; and a planar contact stamped from sheet metal and defining one primary arm essentially seated upon the upward oblique side face, and one secondary arm backward curvedly linked with one end of the primary arm with thereof a free distal end engaged with the downward oblique side face; wherein a first contacting section located at a joint of said primary arm and said secondary arm, is constantly exposed upon the first surface due to said section, and a second contacting section located at a distal end of the primary arm opposite to said joint, is constantly exposed upon the second surface due to a bump formed on said distal end, which is capable to engage the second surface for preventing further movement of the primary arm once the said distal end of said primary arm approaches said second surface, wherein said bump protrudes sideward perpendicular to a plane defined by the contact, wherein said section extends in a vertical manner perpendicular to said first and second surfaces, wherein said slit type passageway owns a constant dimension in a transverse direction perpendicular to a plane defined by the contact, wherein said contact is assembled into the passageway from the second surface to the first surface.

5. The electrical connector as claimed in claim 4, wherein said upward oblique side face is essentially parallel to the downward oblique side face.

6. The electrical connector as claimed in claim 4, wheren the primary arm and the secondary arm extend obliquely relative to each other in the passageway.

7. An electrical connector comprising: an insulative housing defining opposite first and second surfaces thereon; at least one slit type passageway extending through the housing and communicating with both said first and second surfaces; and a planar type contact assembled into the passageway from the second surface, and defining a primary arm and a secondary arm curvedly and backwardly joined with the primary arm; wherein the passageway is configured to engage a free distal end of the secondary arm within the passageway for preventing excessive movement of the contact from the first surface toward the second surface, while to engage a free distal end of the primary arm around an opening in the second surface for preventing excessive movement of the contact from the second surface toward the first surface, wherein engagement between the free distal end of the secondary arm and the housing in the passageway occurs in a first direction parallel to a plane defined by the contact while engagement between the free distal end of the primary arm and the housing around the opening in said second surface occurs in a second direction perpendicular to said first direction, wherein the passageway essentially obliquely in the housing perpendicular to both said first and second surfaces, wherein said passageway defines an upward oblique side face and a downward oblique side face under condition that the engagement between the secondary arm and the housing occurs on said downward oblique side face.

* * * * *